United States Patent [19]

Burleson

[11] Patent Number: 4,649,831

[45] Date of Patent: Mar. 17, 1987

[54] RAIL CAR WITH SPACE ALLOWING FOR OPENING OF END ENCLOSURE

[75] Inventor: Robert M. Burleson, Adamsville, Pa.

[73] Assignee: Greenville Steel Car Company, Greenville, Pa.

[21] Appl. No.: 783,942

[22] Filed: Oct. 3, 1985

[51] Int. Cl.[4] ..... B61D 3/02; B61D 19/00; B60J 5/10

[52] U.S. Cl. ..... 105/378; 105/410; 410/26; 160/196 D

[58] Field of Search ..... 410/26, 27; 105/378, 105/410; 49/40, 41; 160/113, 116, 118, 97, 196 D, 115, 201, 214; 296/55, 155; 52/45, 56

[56] References Cited

U.S. PATENT DOCUMENTS

| | | | |
|---|---|---|---|
| 3,977,123 | 8/1976 | Clam, Jr. et al. | 410/26 X |
| 3,995,563 | 12/1976 | Blunden | 105/378 |
| 4,077,330 | 3/1978 | Peisner et al. | 410/26 X |
| 4,265,183 | 5/1981 | Peisner et al. | 105/410 |
| 4,437,410 | 3/1984 | Stoller, Sr. et al. | 410/26 X |

*Primary Examiner*—Robert B. Reeves
*Assistant Examiner*—Scott H. Werny
*Attorney, Agent, or Firm*—Webb, Burden, Robinson & Webb

[57] ABSTRACT

A rail car having a bed, sidewalls and a curbed roof defined by at least one slope on each side connecting the flat top of the roof with the sidewalls and an end opening. Substantially symmetrical doors close the end opening. The doors are hung such that each can be moved from a position closing a portion of the end opening to a stowed position substantially along the inside of a sidewall. The doors have upper gable portions that substantially entirely fill the upper portion of the end opening. The doors, when in the closed position, substantially stand in one plane. First and second sloped end portions of the roof at each side and near the end opening are arranged with the lower edge thereof parallel to the top edge of the sidewall and spaced a short distance therefrom. When a door is moved to the stowed position it extends upwardly through the space between the sloped portion and the sidewall.

7 Claims, 3 Drawing Figures

RAIL CAR WITH SPACE ALLOWING FOR OPENING OF END ENCLOSURE

BACKGROUND OF THE INVENTION

This invention relates to rail cars adapted for transporting automobiles. More specifically, this invention relates to the end enclosures of rail cars adapted for transporting automobiles. For the security and protection of the automobiles, the rail cars are provided with sidewalls, roof, and end doors. Typically, the rail cars are designed to have a bed and either one or two intermediate decks supported above the bed for holding the automobiles loaded thereon. The automobiles are driven from platforms at the end of the rail car onto either the bed or a deck for loading.

The height of rail cars for carrying automobiles is often critical. Where it is desirable to carry three levels of passenger cars or two levels of vans or trucks, it is essential to raise the roof of the rail car as far as possible. Due to the fact that rail cars through underpasses and tunnels, the height of the roof is limited. The roof can, however, be higher if the edges between the sidewalls and the roof are sloped. The roof is then similar to a gambrel roof on a house except there is no ridge but a flat span between the curbed sides. Indeed, they almost always are sloped. This enables the rail cars to pass through tunnels with arched ceilings even though the highest point on the rail car exceeds the height of the base of the arch.

A number of end enclosure designs are known for rail cars of the type being discussed. Usually, doors slide from the closed position to a position along the inside of the sidewalls. The doors are hung from a track member that is positioned along the edge of one of the decks. A space is provided between the side of the deck and the sidewalls at the end of the rail car so that a portion of the track is spaced and substantially parallel to the sidewalls. Thus, the doors can be moved along the track to a position along the inside of the sidewalls to enable access to the interior of the rail car. A suitable guide track or rail is usually provided adjacent the bottom edges of the doors. The guide track does not hinder the operation of the door and provides security by restricting the outward movement of the lower end of the door. Thus, access may not be gained to the interior of the rail car by pulling out of the bottom edges of the doors away from the opening. A door of the type being described is disclosed in more detail in U.S. Pat. No. 4,437,410. It should be understood, however, that this invention in no way is limited to the specific manner in which the doors are hung and move or fold to enter the space along the sidewall. Other door hanging schemes are used and this invention has equal application thereto. See U.S. Pat. No. 3,996,860 for another end enclosure type to which this invention has applicability.

Since the edges where the roof and sidewalls are joined are sloped, it is not possible to extend the doors upwardly to completely fill the space (the gable space) and still slide the doors back along the sidewalls. The higher portions of the door would interfere with the sloped portions of the roof. Numerous schemes have been devised to attempt to fill the gable space. Some doors are built with the top portions bent inwardly so that they will not interfere with the sloped portion of the roof (see U.S. Pat. No. 4,437,410). In some cases, complicated folding panels close the gable portion of the space (see U.S. Pat. No. 4,265,183). In yet other cases, the gable space is simply left open (see U.S. Pat. No. 3,996,860). The prior art alternatives are not satisfactory since they enable the rail cars to be entered and the automobiles to be vandalized.

It is an advantage according to this invention to provide a rail car with shaped roof and doors that fill the entire upper end of the open end of the rail car but which doors can be easily moved to a stowed position along the sidewall.

SUMMARY OF THE INVENTION

Briefly, according to this invention, there is provided a rail car having a bed, sidewalls and a curbed roof defined by at least one slope on each side of the roof connecting the flat top of the roof with the sidewalls. The rail car has at least one end opening. Substantially symmetrical doors close the end opening. The doors are hung such that each can be moved from a position closing one half of the end opening to a stowed position substantially along the inside of a sidewall. The doors have upper gable portions that substantially entirely fill the upper portion of the end opening. The doors, when in the closed position, for the most part stand in one plane. First and second sloped end portions of the roof at each end near the end opening are arranged with a lower edge parallel to the top edge of the sidewall and spaced a short distance therefrom. Thus an open space is provided between the lower edge of the first and second sloped end portions and the sidewalls. When a door is moved to the stowed position it extends through a space.

According to a preferred embodiment, the doors comprise a plurality of vertical, elongate rigid sections which are hinged together along the long edges thereof. Preferably the space between the end wall and the lower edge of a sloped end portion is less than 6 inches. According to a preferred embodiment, the rail car is provided with at least one deck positioned between the bed and the roof for supporting automobiles. Columns (standards) at each side of the deck near the end thereof are spaced from the sidewall and support the deck. The columns extend upwardly to the height of the top edge of the sidewall and support the lower edge of the sloped end portion of the roof on one side. Most preferably, an eave plate comprising an angle iron is positioned across the top of the columns for supporting the lower edge of the sloped end portions. Preferably, a rain gutter is positioned near the bottom of the sloped end portions. It is desirable that the end edges of the sloped roof be cut back from the center and top to the sides to align with the door in the closed position wherein it is partially wrapped around the deck.

THE DRAWINGS

Further features and other objects and advantages of this invention will become clear from the following detailed description made with the reference to the drawings in which.

DESCRIPTION OF THE PREFERRED EMBODIMENTS

Figure 1:
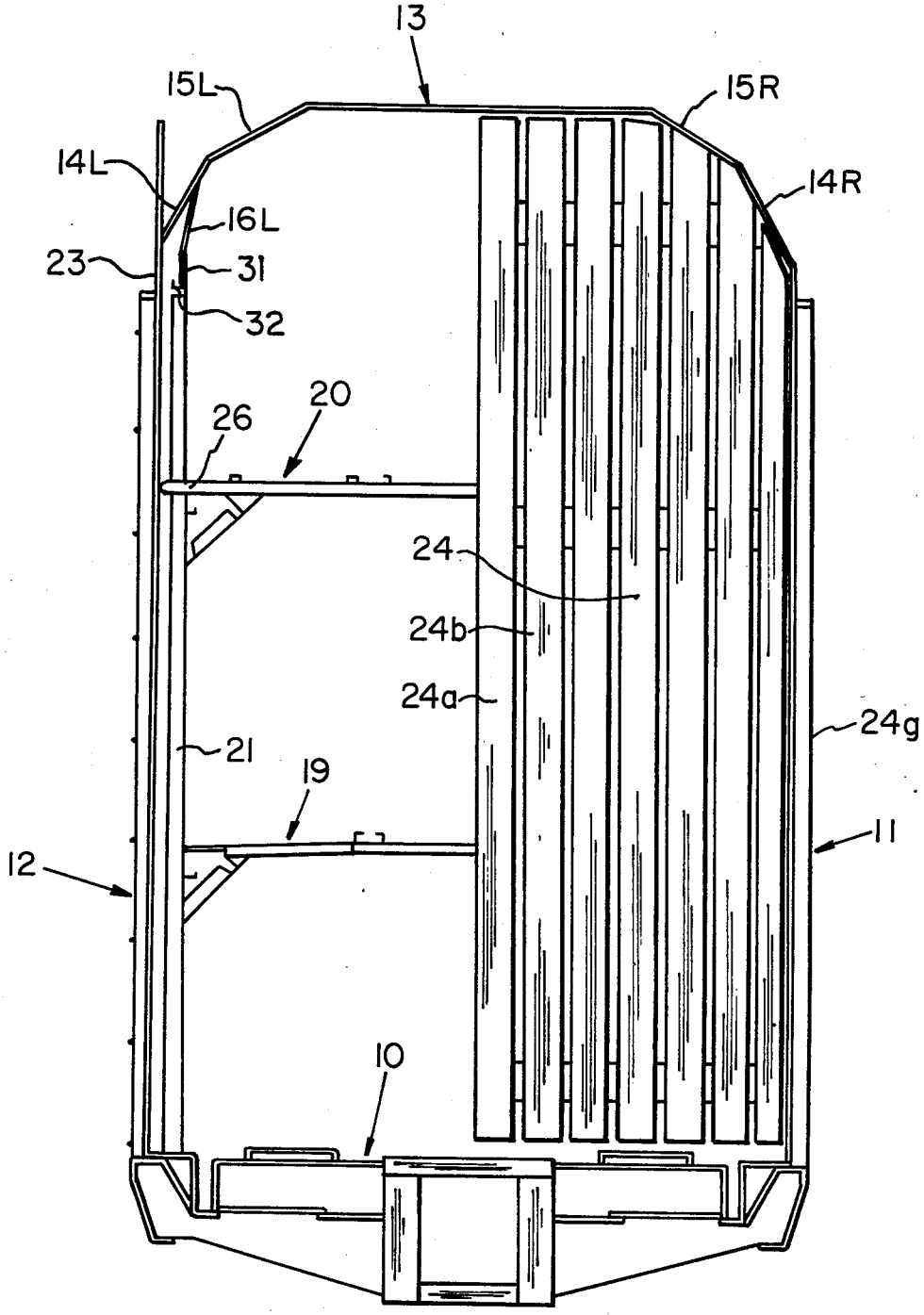
FIG. 1 is an end view of a rail car according to this invention.

Referring now to FIG. 1, there is shown the end of a rail car according to this invention. The rail car comprises a deck 10, sidewalls 11 and 12, and a roof 13. The roof has a flat top and gambrel-like sides comprised of steeply sloped portions 14R, 14L and not so steeply sloped portions 15R, 15L. The rail car is provided with two intermediate decks 19, 20. The decks are supported near the end of the car with columns 21 which are spaced from the sidewalls. Thus a space is provided between the deck and sidewall near the end. The rail cars are provided with substantially symmetrical doors 23 and 24. In FIG. 1, the right door 24 is shown in a closed position and the left door 23 is shown in a stowed position. As can be seen, in the stowed position the door slides between the side edge of the decks 19, 20 on one side and the side wall on the other.

The apparatus for hanging the doors 23, 24 form no part of this invention. However, rail 26 is shown positioned along the end and side edges of the upper deck 20. Rollers and brackets (not shown) slideably interconnect the doors with the rail 26.

As shown in FIG. 1, the doors comprise a plurality of long thin upright sections *24a, 24b, . . . 24g* (seven sections in all). The sections are hinged together at the top, middle and bottom of the doors. According to a preferred embodiment, the sections comprise rigid steel channels. The top ends of the channels are cut to just fit under or even with the roof.

Near the end of the rail car, the steeply sloped portions of the roof (16L on the left side of FIG. 1) are bent inwardly to be even steeper than the steeply sloped portion 14L along the mid-portion of the car. The steeply sloped end portions have a lower edge that is substantially parallel with the sidewalls and spaced therefrom. Thus the doors when rotated into the stowed position (left side of FIG. 1) extend upwardly through the space. In this way, the doors can be moved from the closed to the stowed position without interferring with the roof.

Figure 2:
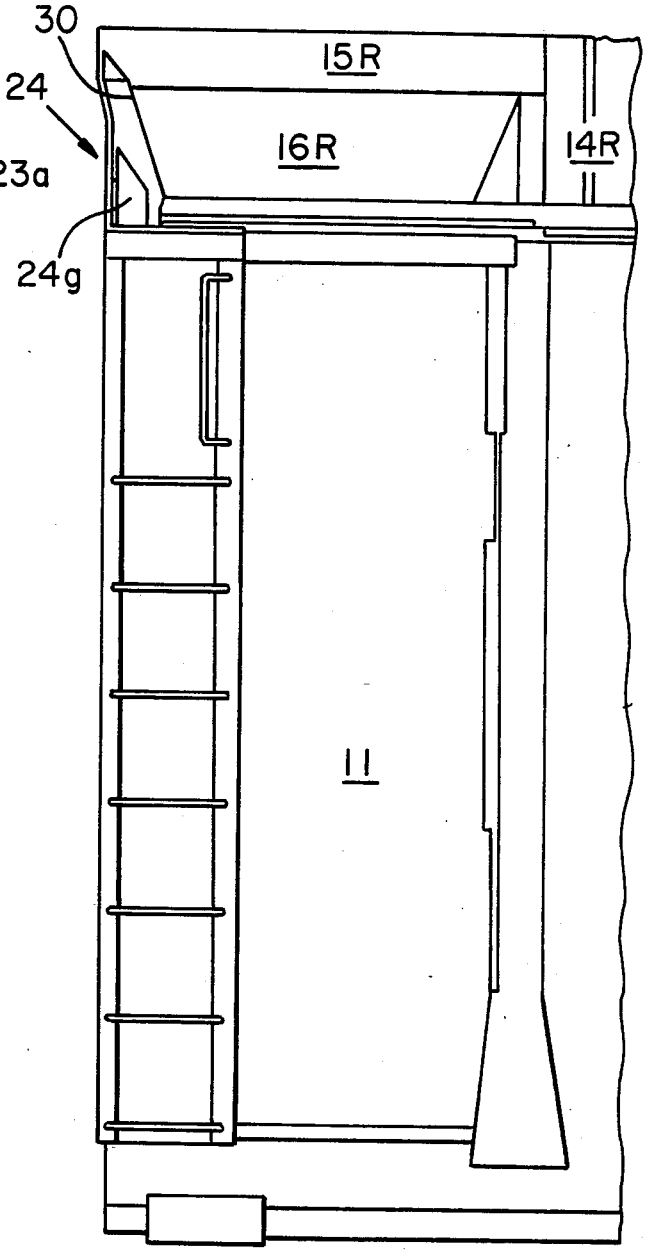
FIG. 2 is a right side view of a rail car according to this invention illustrating the closed position of a door.

Referring now to FIG. 2, there is shown a right side of the rail car with the right door 24 shown in the closed position. The steeply sloped end portion 16R is visible along the side of the somewhat less steeply sloped portion 14R of the roof.

It can be seen that the edge 30 of the end of the roof is cut back from the top center to the sides to accommodate a portion 24g of the door that is turned back around the rail 26.

Figure 3:
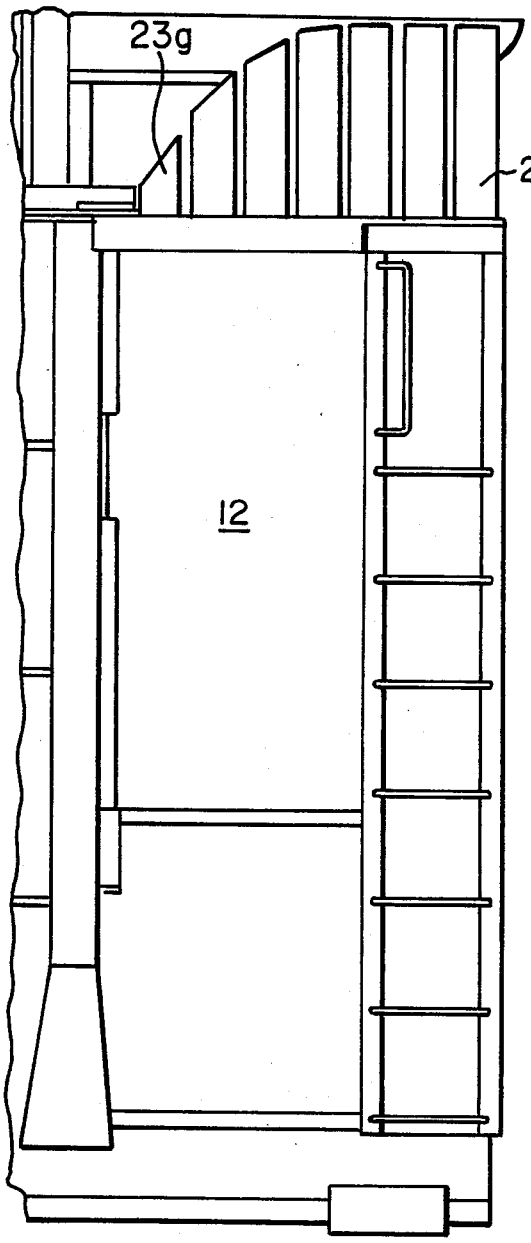
FIG. 3 is a left side view of a rail car according to this invention illustrating the door in the stowed position.

Referring now to FIG. 3, there is shown the left side of the rail car shown in FIG. 1. FIG. 3 illustrates the manner in which the doors extend through the space between the sidewall 12 and the end sloped portion 16L when the door is in the stowed position. The narrow portions 23a through 23g are arranged against the wall 12.

Referring again to FIG. 1, it should be apparent that the end slope portions 16L extends to and connects with the eave plate 31 which in turn is secured to the columns 21. Also secured to the eave plate is a gutter 32 for carrying rain water to the end of the rail car.

Having thus defined my invention with the detail and particularity required by the Patent Laws, what is desired protected by Letters Patent is set forth in the following claims.

I claim:

1. A rail car having a bed, sidewalls and a curved roof defined by at least one slope on each side connecting a flat top of the roof with the sidewalls, an end opening, substantially symmetrical doors for closing the end opening, means for hanging the doors such that each can be moved from a closed position, closing a portion of the end opening to a stowed position substantially along the inside of a sidewall, said doors having upper gable portions that substantially entirely fill the upper portion of the end opening, said doors when in the closed position standing substantially in one plane, first and second sloped end portions of the roof at each side and near the end opening being arranged with the lower edges thereof parallel to the top edge of the sidewall and spaced a short distance therefrom such that when a door is moved to the stowed position it extends upwardly through a space between the sloped end portion and the sidewall.

2. The rail car according to claim 1 wherein the doors comprise a plurality of vertical elongate rigid sections which are hinged together along the long edges thereof.

3. The rail car according to claim 1 wherein the space between the side wall and the lower edge of the first or second sloped end portion is less than six inches.

4. The rail car according to claim 1 wherein at least one deck is positioned between the bed and the roof for supporting automobiles, columns at each side of the deck near the end thereof spaced from the sidewall and supportng the deck, said columns extending upward to the height of the top edge of the sidewall and supporting the lower edge of the first and second sloped end portions.

5. The rail car according to claim 4 wherein an eave plate comprises an angle iron and is positioned across the top of the columns for supporting the lower edge of the first and second sloped end portions.

6. The rail car according to claim 5 wherein a rain gutter is positioned near the bottom of the first and second sloped end portions.

7. The rail car according to claim 5 wherein the end of said roof edges are cut back from the top center to the sides of said roof to accommodate a turned back portion of said doors.

* * * * *